United States Patent [19]

Verdi

[11] Patent Number: 4,601,316

[45] Date of Patent: Jul. 22, 1986

[54] ELECTRIC PENCIL SHARPENER

[75] Inventor: Anthony J. Verdi, Whippany, N.J.

[73] Assignee: Ketcham & McDougall, Inc., Roseland, N.J.

[21] Appl. No.: 781,596

[22] Filed: Sep. 30, 1985

[51] Int. Cl.[4] ..... B43L 23/00

[52] U.S. Cl. ..... 144/28.72; 144/28.6; 144/28.5; 30/453

[58] Field of Search ..... 30/453, 454, 455; 144/28.1, 28.4, 28.5, 28.6, 28.72

[56] References Cited

U.S. PATENT DOCUMENTS 3,678,975 7/1972 Imanishi et al. ..... 144/28.5

*Primary Examiner*—Francis S. Husar

*Assistant Examiner*—Jorji M. Griffin

*Attorney, Agent, or Firm*—Edwin E. Greigg

[57] ABSTRACT

A pencil sharpener which includes a sliding safety shield preventing operation of the sharpener with the pencil drawer removed and further preventing a pencil to be inserted into the sharpener so as to actuate the cutter assembly unless the shavings drawer is in its fully closed position. In addition a stop for a positive stop of the sharpening process is provided in transverse relation to the cutter assembly aperture so as to impinge upon the cutter assembly and stop the cutter assembly at a zero clearance position with a holder therefor, so as to prohibit the formation of a burr or other irregularity on the pencil point.

8 Claims, 3 Drawing Figures

Sec. A-A

ELECTRIC PENCIL SHARPENER

BACKGROUND OF THE INVENTION

1. Field of the Invention

The present invention relates to an electric pencil sharpener provided with a vertically movable safety shield element arranged to prevent a pencil from being sharpened when the drawer which accumulates shavings is removed therefrom. A further novel element of the invention is the provision of a positive stop means associated with the cutter assembly gear which provides for a consistent size of pencil points with no burr or defect thereon.

2. Description of the Prior Art

There have been a number of attempts in the prior art to provide for automatic pencil sharpeners whereby the cutter element and the pencil are disengaged from one another or from the motor power source. An example of this is the patent to Meyers, U.S. Pat. No. 864,671 in which when the pencil is completely sharpened to the desired degree a nut has reached its inner travel limit causing disengagement of a detent arm and the return of the cutter and yoke to an initial inactive position.

Another effort at providing an automatic stop electric pencil sharpener is that patent to Uchida, U.S. Pat. No. 3,777,791. In the Uchida patent when a pencil has been shaved to a desired degree the cutter element is adapted to separate away from its engagement with the end portion of the pencil so as to serve as an automatic stop thereby prohibiting unnecessary shaving of the pencil end portion beyond a predetermined degree of sharpness.

The foregoing are illustrative of attempts to provide automatic means by which to stop the sharpening of the pencil within the cutter assembly. In contrast to these devices of the prior art it is a feature of this invention to provide a novel but extremely simple positive stop for a pencil being shaved in the cutter element.

In the instant invention a blade means is disposed transversely of the cutter assembly so that when the cutter bar shifts on its shaft and the cutter bar cuts, zero clearance between the blade and cutter bar is achieved, and the cutter bar cuts into the blade, perhaps by a few thousandths of an inch. When the cutter bar has cut into the stop to a predetermined depth to take up the production tolerance designed therein, the pencil has been sharpened to a fine point. At that stage the blade is in contact with the point of the pencil, and thus the pencil cannot protrude beyond the cutter assembly in this construction so as to allow creation of the burrs normally formed in ordinary pencil sharpeners. The stop is simple, reliable, and does not require operative moving parts so as to displace the cutter mechanism away from the pencil or to shut off the motor.

As regards the safety element, applicant is not aware of any prior art which is pertinent to the examination of this feature of the invention in which a pencil is impeded from entry into the cutter mechanism when the drawer of the pencil sharpener provided for catching shavings is removed from the sharpener.

OBJECT AND SUMMARY OF THE INVENTION

It is the principal object of the invention to provide a safety shield associated with the pencil entry aperture which prevents entry of a pencil into the unit, so as to turn it on, when the shavings drawer is removed.

It is another object of the invention to provide a pencil sharpener having a positive stop associated with the cutter assembly so as to allow formation of consistent, virtually identially sized points which have no burrs thereon.

It is yet another object of the present invention to provide an improved electric pencil sharpener capable of preventing the insertion of a pencil into the sharpener when the drawer for shavings is open thereby alleviating the prospect of pencil shavings being distributed into the empty drawer cavity.

It is still another object of the present invention to provide a simple positive stop means for preventing the sharpened pencil from overriding the cutter assembly to eliminate during sharpening the cause of burrs being formed on the point.

It is still a further object to provide a pencil sharpener which is efficient and yet simple and reliable to manufacture.

It is yet another object of the invention to provide a stop means on a cutter holder assembly that can be applied to existing pencil sharpeners by replacement or exchange of the cutter assembly or of comparable cutter assembly holder parts.

It is yet a still further object of the invention to provide a pencil sharpener which will not start, and thus prevents the use of the sharpener, when the shavings drawer is removed providing an additional safety factor by preventing access to an operable cutter assembly.

Further objects and advantages of the present invention will become understood with reference to the following drawings and the description of the preferred embodiment. The present invention will be hereinafter fully described in conjunction with its preferred embodiments thereof with reference to the accompanying drawings.

Figure 1:
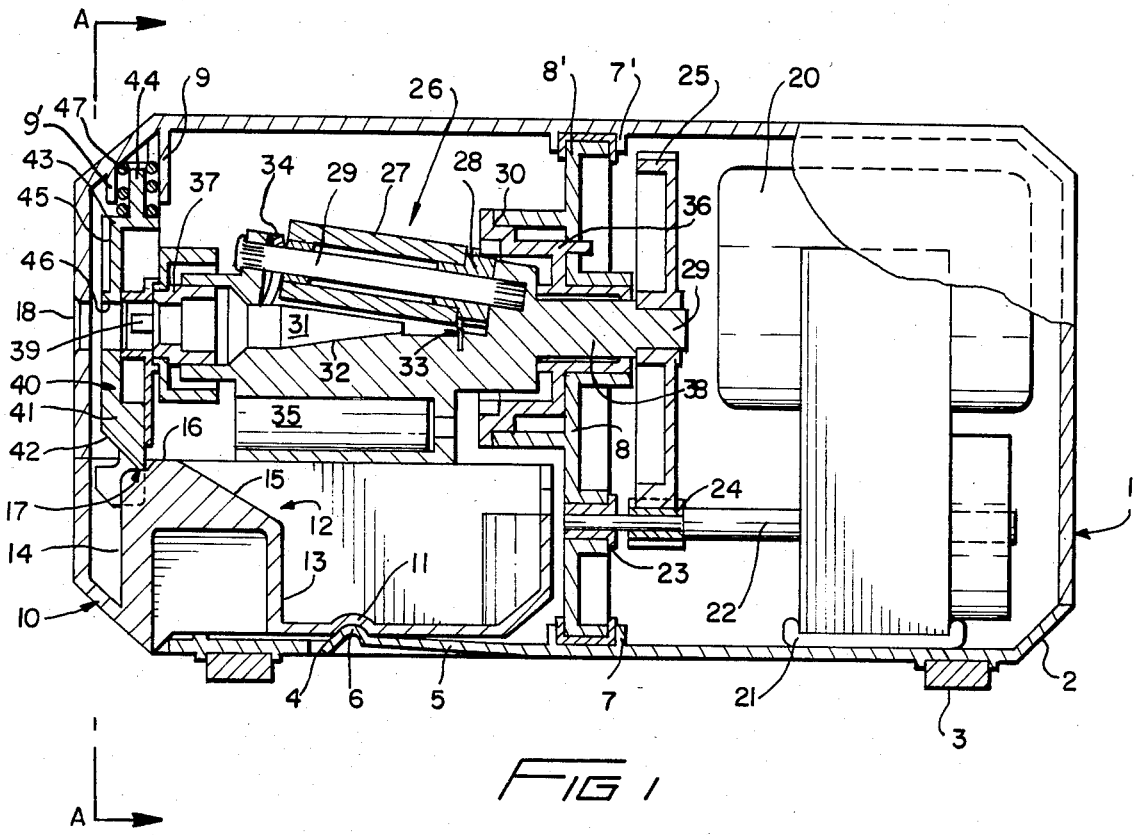
FIG. 1 is a side elevational view of an electric pencil sharpener showing the novel elements of the present invention.

The details disclosed in the drawings and identified therein by reference numerals will now be described, first with reference to FIG. 1.

FIG. 1 shows a housing assembly 1 for a pencil sharpener with an associated base member 2 and feet therefor 3, the base 2 being provided with a notch 4 and a tang assembly 5 with rebent lock means 6 designed to engage a complemental notch 11 provided in the base of a drawer indicated generally at 10. Interiorly of the housing one can see substantially medially thereof a pair of support 7, 7' into which bearings are provided to retain and guide the various gear therewithin. An additional similar internal support means is shown in the forward section of the pencil sharpener and is indicated at 9, 9' and is designed to retain the spring and safety shield assembly described hereinafter.

As indicated, the drawer 10 is provided in the forward base portion of the sharpener housing 1, that drawer being provided with an upstanding blade means 12 provided with an anterior wall 13 and a posterior wall 14, which walls rise to meet in an edge 15 in an upper extremity thereof, said edge being truncated as indicated at 16 and notched as indicated at 17. In the frontal wall of the sharpener housing 1 there is provided an aperture 18 which leads to the cutter assembly.

Motor power for the cutter assembly is provided by a motor 20, secured firmly to a motor mount 8, the motor being provided with a shaft 22 and a bearing 23, a pinion gear 24 being disposed on said shaft designed to drive a large cutter assembly driving gear 25. The large gear 25 is arranged to drive a cutter assembly 26 via a tail shaft 29 on the assembly, the drive being provided through a gear 30 engaging a pinion gear 28 on the cutter assembly 26. The cutter 27 is arranged in this fashion to rotate in the opposite direction to the cutter assembly gear 30; drive pinion 28 is driven via a bearing 36 surrounding the tail shaft portion of the cutter assembly. Cutter bar 27 is mounted upon a shaft 29 and an aperture adjacent thereto is provided denoted as 31 in the figure. A wall 32 of that aperture is provided which is of diminishing radius defining at one end thereof substantially a point adjacent the stop means 33.

As can be seen from the drawing, the stop means 33 comprises a blade-like means which impinges upon the travel of the cutter bar when the gear driving the cutter bar has exceeded its built-in longitudinal design tolerance and is resting on the cutter bar holder; at that stage the cutter bar has ground into the stop means and the pencil then abuts the stop, thus limiting the travel of a pencil beyond the cutter bar once a fine pencil point has been achieved. The thickness of the blade is chosen dependent upon the cutter bar tolerance in rearward travel and is arranged to limit the cutter bar and pencil travel before the pencil exceeds the cutter bar; were the pencil to protrude beyond the cutter bar, a burr might be formed on the point. A cutter holder 38 retains the blade 33 and encapsulates a counterweight 35. An end bearing 37 is provided at the forward extremity of the cutter holder 38 and receives the pencil for entry. A switch means is denoted at 39 which switch actuates the motor to set the cutter assembly in motion upon insertion of a pencil.

The safety shield comprises a slider assembly as indicated at 40 and includes a lower extremity 41 provided with a edge portion 42, and an upper extremity 43 on which is disposed a cylindrical extension 44 about which a spring means 47 may be guided. The slider assembly is provided with an upper face portion 45 oriented upon its descent to block the aperture 18 to travel of a pencil therethrough. In normal circumstances, when the drawer is closed, an aperture 46 allows passage of the pencil through the slider.

Figure 2:
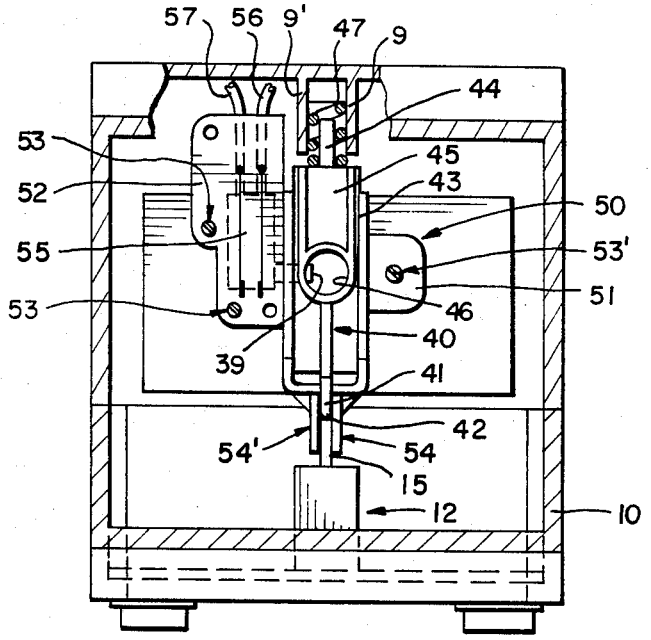
FIG. 2 is a front elevational view in partial section showing the safety shield element and associated guide means therefor.

Referring now to FIG. 2, and a front view of the slider assembly and guide means therefor, one can observe the shaving accumulation tray 10 with its medial wall 12 on which a blade portion 15 is disposed, here shown in abutment with edge 42 of lower extremity 41 of the slider means. The slider element is clearly shown residing within a substantially U-shaped guide means, the guide means being provided with a pair of lower walls 54, 54' in opposed spaced relation to edge 42 and between which the lower extremity 41 of the slider element is guided.

The guide means itself for the slider element is indicated generally at 50 and is provided with a lateral offstanding flange means 51 on one portion thereof and an opposite flange means 52 upon which the switch blades 55 are mounted and retained by a switch cover. Mounting means such as three molded pins are indicated at 53 and 53' through which the guide means is retained to the cutter cover in a positive fashion. Electrical wiring for the switch is shown generally at 56 and 57.

Figure 3:
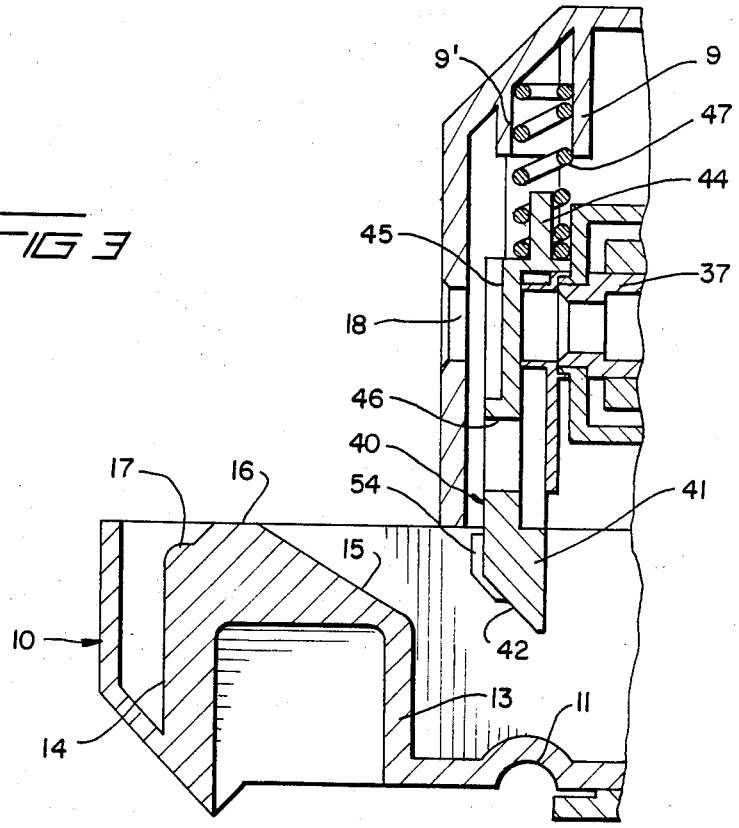
FIG. 3 is a partial sectional side view on an enlarged scale showing the interaction of the open drawer with the safety shield, the guide assembly and the spring associated therewith.

Referring now to the enlarged fragmentary view shown in FIG. 3, the drawer 10 can be seen in an opened position, in which the slider element 40 has descended to a position in which the face 45 now covers aperture 18 impeding entry to the internal aperture 31 adjacent the cutter assembly. In this position, it is clearly shown that the lower extremity 41 has descended below the walls 54, 54' of the guide means so that the edge 42 thereof is below the edge 15 of the upstanding blade means. The spring 47 is seen in its expanded untensed position, having assisted gravity in urging the slider element down through the guide means to its position shown.

In operation, one pushes the drawer 10 forward toward the housing and edge 42 will engage edge 15 on the upstanding blade means in the drawer, and the edge 42 will have a tendency to ride upwardly on edge 15 as the drawer is urged to close. In a fully closed position, edge 42 will ride across the entire extremity of edge 15, pass over the truncated area 16 feeding itself onto notch 17; notch 17 serves to retain the drawer in a positive closed position. Thus, when the drawer is closed it will be possible to insert a pencil into the aperture in front of the sharpener, so as to turn the unit on and sharpen the pencil.

Now if someone attempts to remove the drawer while the pencil is being sharpened, it would not come out. Therefore, a first safety feature is provided to the extent that no one can remove the drawer and put their fingers inside the pencil sharpener, child or otherwise, while a pencil is inserted through the aperture, the unit is running or coasting to a stop and the cutter assembly is turning. When the pencil is removed and the unit is off, the drawer can be removed. Having removed the drawer the safety shield will drop down, spring assisted, behind the pencil aperture and prevent anyone from inserting a pencil or other object and starting the unit while the drawer is missing, thus providing a second safety feature. When the drawer is reinserted and closed, the safety shield will be lifted out of the way and the unit will be ready for the next pencil to be sharpened.

The positive stop operates in the following fashion. The stop is disposed rearwardly of the cutter bar on the cutter assembly in very close relationship to to the helical cutting edge thereof. The thickness of the stop is chosen in accordance with the play between gear 28 and the cutter assembly holder 38, such that the cutter bar cuts into the stop for a few thousandths of an inch until the gear face rests against the cutter assembly holder, thus creating zero clearance between cutter bar and stop. At that point, the pencil meets the stop and cannot be forced farther into the cutter assembly so as to exceed the rearward extremity of the cutter bar with its point, and thus no burr can be formed on the point. It has been observed that no burrs are formed when the cutter bar and pencil point are flush against the stop.

Various modifications and variants upon the invention and its novel elements are within the scope of this invention, which is defined by the appended claims.

What is claimed and desired to be secured by Letters Patent of the United States is:

1. In an electrical pencil sharpener having a housing, a front wall and a slidable shaving accumulation tray, a power source, a switch and a motor, a cutter holding element rotatable in one direction by said motor when said switch is actuated, cutter means operatively carried by said cutter holding element and arranged to be rotated in a direction opposite to the rotational direction of said cutter holding element, the combination comprising said front wall of said housing having an aperture therein, said aperture in axial alignment with an aperture in said cutter means, vertically movable means provided with an aperture to control insertion of a pencil into said cutter means, said vertically movable means disposed between said housing front wall and said cutter means, said vertically movable means being movable from an operative pencil receiving position when said respective apertures are in alignment into a pencil blocking position to prevent insertion of said pencil when said shaving accumulation tray is removed from said housing.

2. In an electrical pencil sharpener as claimed in claim 1, further wherein a stop means is disposed on said cutter holding element such that a longitudinal extent of said stop means is contacted by the cutter means and self adjusts to zero clearance between said cutter means and said stop means giving a burr free point to a pencil sharpened thereby.

3. In an electrical pencil sharpener as claimed in claim 2, further wherein said cutter assembly includes a gear means arranged to contact a wall of said cutter holding element when said cutter assembly contacts said stop means, whereby said cutter assembly self-adjusts to eliminate any gap between said cutter assembly and said stop means thereby giving a burr free point on a pencil sharpened therein.

4. In an electrical pencil sharpener as claimed in claim 1, further wherein said vertically movable means comprises a slider element retained by a guide means.

5. In an electrical pencil sharpener as claimed in claim 1, further wherein said slider element is urged downwardly by spring means disposed above said slider element.

6. In an electrical pencil sharpener as claimed in claim 1, further wherein said slider element is actuated by mechanical control means disposed in said shaving accumulation tray.

7. In an electrical pencil sharpener as claimed in claim 6, further wherein said mechanical control means further comprises an upstanding blade means upon which said slider element is arranged to ride from said pencil receiving position wherein said shaving accumulation tray is closed to said pencil blocking position when said tray is opened.

8. In an electrical pencil sharpener as claimed in claim 7, further wherein said slider element is provided with a lower extremity for cooperation with an edge of an upper extremity of said blade means.

* * * * *

UNITED STATES PATENT AND TRADEMARK OFFICE

CERTIFICATE OF CORRECTION

PATENT NO. : 4,601,316

DATED : July 22, 1986

INVENTOR(S) : Anthony J. Verdi

It is certified that error appears in the above–identified patent and that said Letters Patent are hereby corrected as shown below:

Page 3, column 2, line 4, "identially" should read

--- identically ---.

Signed and Sealed this

Seventh Day of October, 1986

[SEAL]

*Attest:*

DONALD J. QUIGG

*Attesting Officer*

*Commissioner of Patents and Trademarks*